United States Patent [19]

Fukugawa et al.

[11] Patent Number: 4,582,784

[45] Date of Patent: Apr. 15, 1986

[54] PHOTOGRAPHIC LIGHT-SENSITIVE ELEMENT WITH BACKING LAYER

[75] Inventors: Masafumi Fukugawa; Shinzi Kataoka; Yukio Shinagawa; Itsuo Fujiwara, all of Kanagawa, Japan

[73] Assignee: Fuji Photo Film Co., Ltd., Kanagawa, Japan

[21] Appl. No.: 662,102

[22] Filed: Oct. 18, 1984

[30] Foreign Application Priority Data

Oct. 19, 1983 [JP] Japan ..... 58-195825

[51] Int. Cl.[4] ..... G03C 1/86

[52] U.S. Cl. ..... 430/531; 430/523; 430/526; 430/536

[58] Field of Search ..... 430/523, 531, 536, 526

[56] References Cited

U.S. PATENT DOCUMENTS

| | | | |
|---|---|---|---|
| 3,514,291 | 5/1970 | Vanpoecke et al. | 430/531 |
| 3,525,621 | 8/1970 | Miller | 430/531 |
| 4,248,363 | 2/1981 | Kolb et al. | 430/523 |
| 4,358,533 | 11/1982 | Tokitou et al. | 430/531 |
| 4,374,924 | 2/1983 | Yokoyama et al. | 430/531 |
| 4,388,402 | 1/1983 | Mukunoki et al. | 430/531 |
| 4,409,322 | 10/1983 | Ezaki et al. | 430/523 |
| 4,431,727 | 2/1984 | Steklenski | 430/531 |
| 4,447,525 | 5/1984 | Vallarino et al. | 430/523 |
| 4,480,026 | 10/1984 | Ashcraft et al. | 430/523 |

*Primary Examiner*—Jack P. Brammer

*Attorney, Agent, or Firm*—Sughrue, Mion, Zinn, Macpeak and Seas

[57] ABSTRACT

A photographic light-sensitive material comprising at least one light-sensitive photographic emulsion layer on a support and a back layer provided on the reverse side of the support, wherein the uppermost surface layer of the back layer comprises a hydrophobic polymer binder and a hydrophilic polymer binder.

5 Claims, No Drawings

PHOTOGRAPHIC LIGHT-SENSITIVE ELEMENT WITH BACKING LAYER

FIELD OF THE INVENTION

The present invention relates to photographic light-sensitive materials having improved anti-adhesive properties and improvements in uneven drying. Particularly, the present invention relates to photographic light-sensitive materials wherein uneven drying is improved by improving the wetting property of the back layer to water.

BACKGROUND OF THE INVENTION

Photographic light-sensitive materials are generally composed of light-sensitive photographic emulsion layers and, if necessary, light-insensitive layers such as an interlayer, an emulsion protective layer, a filter layer, an anti-static layer or an anti-halation layer, applied to one side or both sides of a support consisting of an $\alpha$-olefin such as polyethylene or polystyrene, a cellulose ester such as cellulose acetate or nitrocellulose, a polyester such as polyethylene terephthalate, paper, a synthetic paper or a sheet prepared by coating both sides of paper with the above described materials, directly or indirectly through a subbing layer.

Generally, in some light-sensitive materials, light-insensitive auxiliary layers such as an anti-halation layer, an anti-static layer, an entanglement preventing layer, a curl preventing layer or an overcoat layer, are provided on the back surface of the above described photographic light-sensitive materials in order to enhance the photographic or physical quality of the photographic light-sensitive materials.

In recent years, light-sensitive materials are subjected to severer processing conditions than in the past because of the development of the use or the processing of the light-sensitive materials, such as high-speed photographing or high-speed processing, and diversification of the processing environment such as processing under an atmosphere at a high temperature and a high humidity. As a result, problems of adhesion arise.

As a method of improving the problems of adhesion (improving the anti-adhesive property), for example, Japanese Patent Publication No. 6577/82 discloses a back layer containing a cellulose ester as a binder and an organic fluoro compound. Generally, a cellulose ester is used as a binder for the back layer in order to prevent problems of adhesion between the back layer and an emulsion layer or an interlayer during application and problems of adhesion between the back layer and a protective layer.

When producing or using photographic light-sensitive materials, static electricity tends to accumulate. This accumulation of static electricity causes many problems. The electrification arises, for example, when the photographic light-sensitive material is brought into contact with rolls in the production step or the photographic light-sensitive material is subjected to friction between the support surface and the emulsion surface or separation thereof in the winding or rewinding step. Further, it arises due to separation of the emulsion surface from the support when the light-sensitive material is exposed to so high humidity that it causes adhesion. Further, electrification arises when using a movie camera or an automatic development apparatus, for example, X-ray films. When the accumulated static electricity is discharged, the light-sensitive material is exposed to light and, consequently, an irregular static mark such as a spot, branched or feathery static mark, is formed after development processing. As a result, the commercial value of the photographic light-sensitive material is reduced. Since the presence of this static mark is not found until the development processing has been performed, it is one of the most troublesome problems. Moreover, the accumulated static electricity causes dust to adhere to the surface of the light-sensitive material which results in secondary problems arising such as uneven application and the like. Since light-sensitive materials all have a hydrophobic support, accumulation of static electricity is great, and, consequently, generation of static marks increases with an increase in the processing rate and the sensitivity of emulsions is adversely affected.

As a process for preventing such problems due to electrification and preventing the problems of adhesion, Japanese Patent Publication No. 56059/82 discloses an anti-static process comprising incorporating a polymer binder in the uppermost surface layer of the back layer and incorporating an ionen type polymer having dissociation groups in the main chain of the polymer in the layer adjacent to the uppermost surface layer, as an anti-static agent. However, when such photographic light-sensitive materials are processed with an automatic development apparatus, spotted drying unevenness sometimes occurs; such occurrence is particularly remarkable in the case of high-speed development processing.

SUMMARY OF THE INVENTION

An object of the present invention is to provide photographic light-sensitive materials wherein drying unevenness is prevented.

Another object of the present invention is to provide photographic light-sensitive materials having excellent anti-static properties and excellent anti-scratching properties.

As a result of earnest studies, the present inventors have found that, when the binder of the uppermost surface layer of the back layer is composed of a hydrophobic binder such as a cellulose ester, the wetting property of the back layer to water is inferior and water on the back layer is repelled so as to form water drops in the step of drying after subjecting the material to processings such as development, fixing and water washing, by an automatic development apparatus, such that drying of the photographic light-sensitive emulsion layer on the reverse side of the part where water drops adhere causes spotted drying unevenness. Thus, the objects of the present invention have been attained by incorporating a hydrophobic polymer binder and a hydrophilic polymer binder in the uppermost surface layer of the back layer.

DETAILED DESCRIPTION OF THE INVENTION

As the hydrophobic polymer binders used in the uppermost surface layer of the back layer in the present invention, there are cellulose diacetate, cellulose triacetate, cellulose acetate butyrate and cellulose propionate, all of which are excellent in anti-adhesive properties and anti-scratching properties and excellent in compatibility with the hydrophilic polymers. Particularly, cellulose diacetate and cellulose triacetate are excellent to use.

As the hydrophilic polymer binders used in the uppermost surface layer of the back layer in the present invention, there are copolymers and homopolymers composed of alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride and itaconic anhydride, and cellulose derivatives. Two or more of these polymers can be used in combination.

Specific examples of the hydrophilic polymers include the following compounds, but the present invention is not limited to them.

Methyl methacrylate-arylic acid copolymer (83:17, % by mol), methyl methacrylate-acrylic acid copolymer (88:12, % by mol), methyl methacrylate-itaconic acid copolymer (90:10, % by mol), methyl methacrylate-maleic acid copolymer (92:8, % by mol), styrene-acrylic acid copolymer (85:15, % by mol), methyl methacrylate-methacrylic acid copolymer (88:12, % by mol), methyl methacrylate-methacrylic acid copolymer (85:15, % by mol), ethyl methcarylate-methacrylic acid copolymer (86:14, % by mol), ethyl methacrylate-methacrylic acid copolymer (83:17, % by mol), butyl methacrylate-methacrylic acid copolymer (80:20, % by mol), tert-butyl methacrylate-acrylic acid copolymer (84:16, % by mol), propyl methacrylate-methacrylic acid copolymer (82:18, % by mol), styrene-butyl acrylate-methacrylic acid copolymer (45:40:15, % by mol), styrene-vinyl acetate-methacrylic acid copolymer (40:45:15, % by mol), butyl methacrylate-2-hydroxyethyl methacrylate copolymer (30:70, % by mol), butyl methacrylate-2-hydroxyethyl acrylate copolymer (40:60, % by mol), butyl methacrylate-2-hydroxypropyl methacrylate copolymer (35:65, % by mol), butyl methacrylate-diethylene glycol monomethacrylate copolymer (45:55, % by mol), methyl methacrylate-2-hydroxyethyl methacrylate copolymer (42:58, % by mol), methyl methacrylate-methacrylic acid-acrylic acid copolymer (84:8:8, % by mol), methyl methacrylate-methacrylic acid-2-hydroxyethyl methacrylate copolymer (60:10:30, % by mol), cellulose acetyl phthalate, cellulose acetyl hexahydrophthalate, methyl cellulose, ethyl cellulose, hydroxyethyl cellulose, hydroxypropyl cellulose, methyl methacrylate-vinyl alcohol copolymer (75:25, % by mol), ethylene-vinyl alcohol copolymer (70:30, % by mol), vinyl acetate-vinyl alcohol copolymer (30:70, % by mol), cyanoethyl cellulose, hydroxymethyl cellulose, cellulose acetyl hexahydrophthalate, hydroxypropylmethyl cellulose acetyl phthalate, hydroxypropylmethyl cellulose acetyl hexahydrophthalate, hydroxypropylmethyl cellulose phthalate, methyl cellulose phthalate, methyl cellulose hexahydrophthalate, methyl cellulose acetyl hexahydrophthalate and methyl cellulose acetyl phthalate.

The amount of the hydrophilic polymers used in the present invention varies according to the kind, the form or the coating process of the photographic light-sensitive material to be used. However, a mixing ratio of the hydrophobic polymer (such as cellulose diacetate or cellulose triacetate) to the hydrophilic polymer is preferred to be in such an amount that the hydrophilic polymer is 5 to 80% by weight and, preferably, 10 to 40% by weight, of the total binder.

The amount of the total binder to be applied is preferred to be in a range of 0.01 to 2 g and, preferably, 0.05 to 1 g, per $m^2$. The amount of the hydrophilic polymers to be applied is preferred to be in a range of 0.001 to 1.6 g and, preferably, 0.005 to 0.4 g, per $m^2$.

The layer adjacent to the uppermost surface layer of the back layer containing a hydrophobic polymer binder and a hydrophilic polymer binder of the present invention may contain a hydrophobic polymer binder, a hydrophilic polymer binder or a mixture of a hydrophobic polymer binder and a hydrophilic polymer binder. However, it is preferable to use a hydrophilic polymer binder, because coating of the uppermost surface layer is advantageously carried out and adhesion between the uppermost surface layer and the adjacent layer is excellent. The adjacent layer may be composed of an ionen type polymer as described in Japanese Patent Publication No. 56059/82. This adjacent layer may contain anti-static agents, dyes and crosslinking agents in addition to the binder.

When the adjacent layer is an ionen type polymer layer or a layer composed of an ionen type polymer and a hydrophilic binder, particularly excellent photographic light-sensitive materials are obtained, wherein the coating property is excellent, adhesion between the uppermost surface layer and the adjacent layer is excellent, and the anti-adhesive property between the uppermost surface layer and the support, an undercoat layer, a light-sensitive layer or a protective layer is excellent, the anti-scratching property and anti-static property are excellent, and drying unevenness does not occur upon processing.

The uppermost surface layer of the back layer of the present invention may contain, if necessary, anti-static agents, matting agents, lubricants, dyes and crosslinking agents.

In order to apply the uppermost surface layer of the back layer containing hydrophilic polymers of the present invention to photographic light-sensitive materials, spraying, coating or dipping is carried out using water, organic solvents (for example, methanol, ethanol, acetone, methyl ethyl ketone, ethyl acetate, acetonitrile, dioxane, dimethylformamide, dimethyl sulfoxide, methyl cellosolve, ethyl cellosolve and methylene chloride), or a mixed solvent thereof, followed by drying.

As supports capable of being employed in the present invention, there are, for example, films of polyolefins such as polyethylene, polystyrene, cellulose derivatives such as cellulose triacetate, or polyesters such as polyethylene terephthalate, baryta paper, synthetic paper, sheets prepared by coating both sides of paper with a polymer film, and analogues thereof.

As photographic light-sensitive materials according to the present invention, there are conventional black-and-white silver halide light-sensitive materials (for example, black-and-white light-sensitive materials for photographing, black-and-white light-sensitive materials for X-rays and black-and-white light-sensitive materials for printing), conventional multilayer color light-sensitive materials (for example, color reversal films, color negative films and color positive films), and various other photographic light-sensitive materials.

The following Examples are provided to illustrate the present invention in greater detail, but are in no way intended to limit the scope thereof.

In the Examples, "part" means "part by weight".

EXAMPLE 1

Coating solutions for a back layer having compositions I, II and III shown in Table 1 were applied to cellulose triacetate film supports so as to be 50 g/m$^2$ and dried at 90° C. for 3 minutes to form a back layer. Thus, films I, II and III having a back layer were obtained.

TABLE 1

| | Coating solution for back layer | | |
|---|---|---|---|
| | I | II | III |
| Cellulose diacetate | 0.5 part | 0.5 part | — |
| Finely divided granular silica (particle size: less than 1μ) | 0.05 part | 0.05 part | 0.05 part |
| Acetone | 100 parts | 100 parts | 100 parts |
| Cellulose acetyl phthalate | — | 0.15 part | 0.5 part |

On the reverse side of the back layer of the films I, II and III, a silver halide emulsion layer containing 4 g/m$^2$ of gelatin and 5 g/m$^2$ of silver iodobromide (iodine content: 2% by mol) and a protective layer containing 1 g/m$^2$ of gelatin were provided to produce indirect X-ray films I, II and III. The X-ray films I, II and III were processed with a developing solution: RD - 3 (produced by Fuji Photo Film Co., Ltd.) and a fixing solution: Fuji - F (produced by Fuji Photo Film Co., Ltd.) for the whole processing time of 90 seconds by means of an automatic developing apparatus: RU - II (produced by Fuji Photo Film Co., Ltd.). The drying temperature was 35° C.

The degree of occurrence of drying unevenness was examined by observing the processed film with naked eyes. The results of drying unevenness are shown in Table 2.

In order to examine the anti-adhesive property, the X-ray films which were not processed were cut in a size of 35 mm×35 mm. After being allowed to stand in an atmosphere at 25° C. and 80% RH for 24 hours, 5 sets of 2 sheets were piled up and allowed to stand under a load of 2 kg in the same atmosphere as described above for 24 hours. Thereafter, they were taken out, the films were separated, and the adhesion area between the back layer and the protective layer was examined. The case that the adhesion area was 0 to 5% was evaluated as A, the case of 6 to 10% was evaluated as B, the case of 11 to 20% was evaluated as C, the case of 21 to 30% was evaluated as D, and the case of 31% or more was evaluated as E. The results of the evaluation of adhesion are shown in Table 2.

TABLE 2

| X-ray film | Drying unevenness | Anti-adhesive property |
|---|---|---|
| I | Occurrence | A |
| II | No occurrence | A |
| III | No occurrence | D |

As can be understood from Table 2, film II of the present invention was a photographic light-sensitive material having excellent anti-adhesive properties and did not cause the occurrence of drying unevenness.

EXAMPLE 2

A coating solution for the back layer prepared by dissolving 8 g of the following ionen type polymer having a molecular weight of 10,000 in 10 ml of water and diluting with a mixed solvent composed of 650 ml of methanol and 350 ml of acetone was applied to a cellulose triacetate film support so as to be 50 mg/m$^2$, and dried at 100° C. for 3 minutes to form a back layer.

To the resulting layer, back coating solution IV, V or VI shown in Table 3 was employed for the uppermost surface layer and was applied so as to be 30 g/m$^2$ and dried at 90° C. for 3 minutes to form an uppermost surface layer of the back layer. Thus, films IV, V and VI having a back layer were obtained.

TABLE 3

(Ionen type polymer)

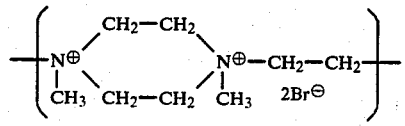

| | Back coating solution of uppermost surface layer | | |
|---|---|---|---|
| | IV | V | VI |
| Cellulose diacetate | 0.5 part | 0.5 part | — |
| Finely divided granular silica (particle size: less than 1μ) | 0.05 part | 0.05 | 0.05 part |
| Acetone | 80 parts | 80 parts | 80 parts |
| Methanol | 20 parts | 20 parts | 20 parts |
| Methyl methacrylate-methacrylic acid copolymer (85:15, % by mol) | — | 0.1 part | 0.5 part |

On the reverse side of the back layer of the resulting films IV, V and VI, a silver halide emulsion layer and a protective layer were provided by the same manner as in Example 1 to produce indirect X-ray films IV, V and VI.

Using the resulting X-ray films IV, V and VI, tests of drying unevenness and anti-adhesive property were carried out in the same manner as in Example 1. The results are shown in Table 4.

In order to examine the anti-static ability, X-ray films IV, V and VI which were not processed were allowed to stand in an atmosphere at 25° C. and 30% RH for 24 hours. Thereafter, a rubber roll was rolled on the surface of the light-sensitive layer side to generate static electricity. After development processing was carried out with the same automatic development apparatus described in Example 1, static marks were examined. The results are shown in Table 4.

TABLE 4

| X-ray film | Drying unevenness | Anti-adhesive property | Static marks |
|---|---|---|---|
| IV | Occurrence | A | No occurrence |
| V | No occurrence | A | No occurrence |
| VI | No occurrence | E | No occurrence |

As can be understood from Table 4, film V provided with an uppermost surface layer of the present invention on the back was a film having excellent anti-adhesive properties and did not cause the occurrence of drying unevenness.

While the invention has been described in detail and with reference to specific embodiment thereof, it will be apparent to one skilled in the art that various changes and modifications can be made therein without departing from the spirit and scope thereof.

What is claimed is:

1. A photographic light-sensitive element comprising at least one light-sensitive photographic emulsion layer on a support and a back layer provided on the reverse side of the support, wherein a layer comprising a hydrophilic polymer is present between the uppermost surface layer of said back layer and the support, wherein the uppermost surface layer of said back layer comprises a hydrophobic polymer and 5 to 80% by weight of a hydrophilic polymer based on the weight of the total polymers which are employed in a total amount of 0.01 to 2 g per $m^2$, wherein said hydrophobic polymer is selected from the group consisting of cellulose diacetate, cellulose triacetate, cellulose acetate butyrate and cellulose propionate and wherein said hydrophilic polymer is selected from the group consisting of copolymers and homopolymers of alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, maleic anhydride and itaconic anhydride.

2. The photographic light-sensitive element as claimed in claim 1, wherein said hydrophobic polymer is selected from the group consisting of cellulose diacetate and cellulose triacetate.

3. The photographic light-sensitive element as claimed in claim 1, wherein the uppermost surface of said back layer comprises 10 to 40% by weight of the hydrophilic polymer based on the total polymers.

4. The photographic light-sensitive element as claimed in claim 1, wherein said polymers are employed in a total amount of 0.05 to 1 g per $m^2$.

5. The photographic light-sensitive element as claimed in claim 1, wherein the layer present between the uppermost surface layer of said back layer and the support additionally contains an ionene type polymer.

* * * * *